US006257042B1

(12) United States Patent
Välimäki et al.

(10) Patent No.: US 6,257,042 B1
(45) Date of Patent: Jul. 10, 2001

(54) OPEN THROAT CRIMPING MACHINE

(75) Inventors: Jorma Välimäki; Jari Hakonen, both of Kauhava (FI)

(73) Assignee: Lillbacka Oy, Kauhava (FI)

( * ) Notice: Subject to any disclaimer, the term of this patent is extended or adjusted under 35 U.S.C. 154(b) by 0 days.

(21) Appl. No.: 09/434,255

(22) Filed: Nov. 5, 1999

(51) Int. Cl.[7] ..... B21D 41/04
(52) U.S. Cl. ..... 72/402; 29/237
(58) Field of Search ..... 702/402, 416, 702/456; 29/237

(56) References Cited

U.S. PATENT DOCUMENTS

| | | | | |
|---|---|---|---|---|
| 3,568,495 | * | 3/1971 | Duffield | 72/402 |
| 4,472,959 | * | 9/1984 | Fencl | 72/402 |
| 4,785,656 | | 11/1988 | Kennedy | 72/402 |
| 4,805,278 | | 2/1989 | Bulanda et al. . | |
| 5,243,846 | * | 9/1993 | Davis | 72/402 |
| 5,275,032 | | 1/1994 | Gloe et al. | 72/446 |
| 5,323,697 | * | 6/1994 | Schrock | 72/402 |
| 5,437,177 | * | 8/1995 | Orcutt | 72/402 |
| 5,715,723 | * | 2/1998 | Owens | 72/402 |
| 5,727,409 | | 3/1998 | Inoe | 72/412 |

FOREIGN PATENT DOCUMENTS

| | | | |
|---|---|---|---|
| 42 41 955 A1 | 6/1994 | (DE) . | |
| 198 17 882 | 11/1999 | (DE) | 72/402 |
| 0 643 457 A1 | 3/1995 | (EP) . | |
| 93-7711 | 11/1993 | (KR) | 72/402 |

* cited by examiner

*Primary Examiner*—Daniel C. Crane
(74) *Attorney, Agent, or Firm*—Louis Woo

(57) ABSTRACT

The present invention crimping machine has mounted to each end of a C-shaped frame a sub-frame to which is fixedly coupled one half of a master die. The two halves of the master die are positioned opposed to each other so that when they come together, a concentric aperture is formed. Each half of the master die is made up of a number of master die segments. To some of these segments there are removably attached a corresponding crimp die segment. Thus, one set of crimp dies is positioned opposed to another set of crimp dies. When in an opened position, the opposed sets of the crimp dies are separated by a channel which distance can be selectively controlled. When moved to the closed position, the crimp die segments each would exert the same force against the workpiece to thereby effect an even pressing of the workpiece, be it a crimping, forming or some other pressing operation. A workpiece that is to be crimped can be inserted between the crimp dies via a number of directions, and the crimp die can readily be exchanged with another crimp die by using a special exchange tool.

29 Claims, 5 Drawing Sheets

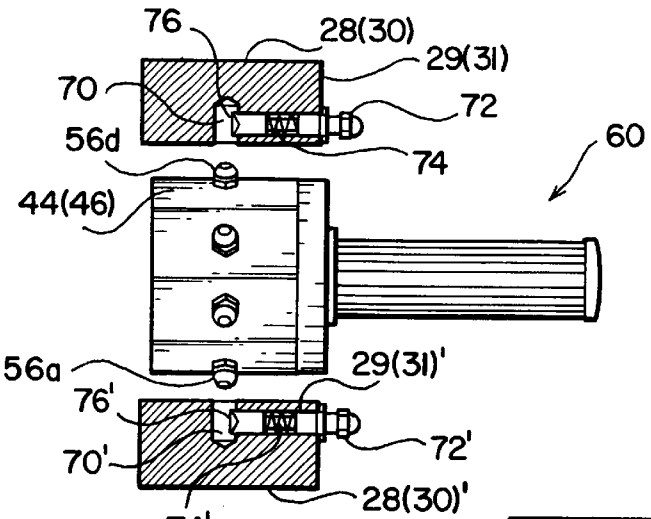
FIG. 8
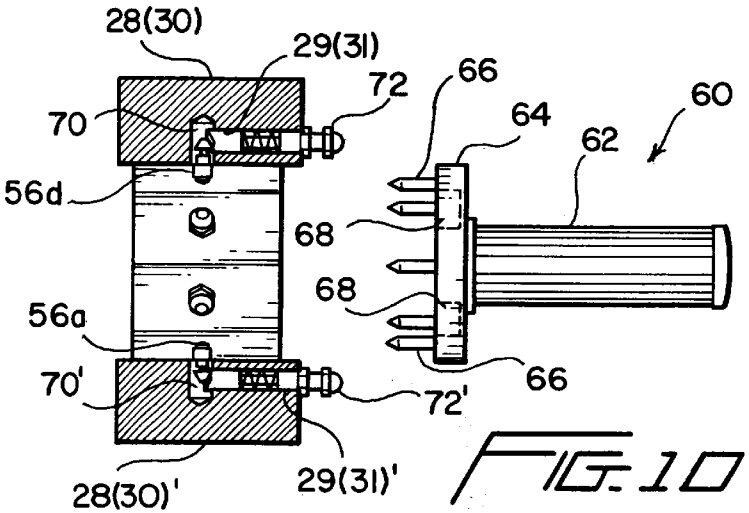
FIG. 10
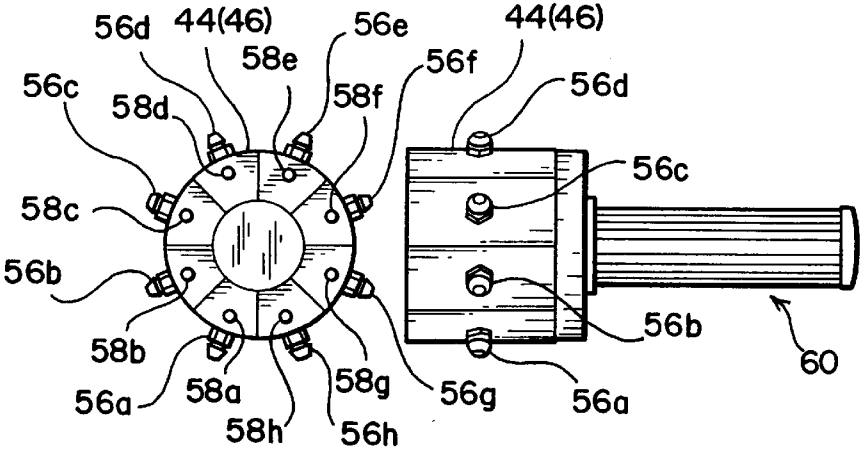
FIG. 7A
FIG. 7B
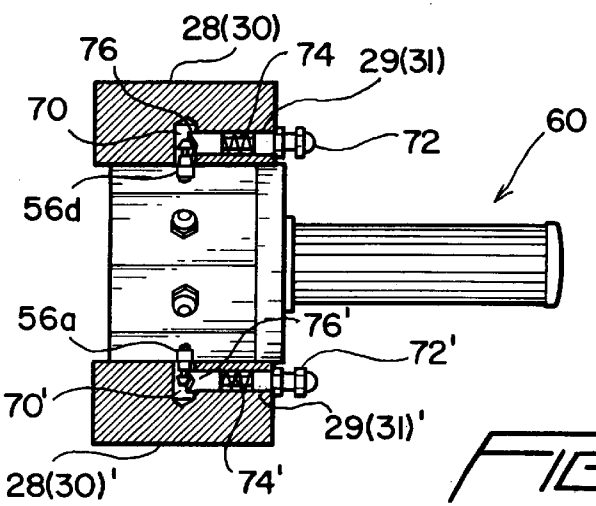
FIG. 9

OPEN THROAT CRIMPING MACHINE

FIELD OF THE INVENTION

The present invention relates to crimping and swaging machines and more particularly to a crimping machine that has an open channel through which a to be crimped workpiece could pass between two sets of crimp dies.

BACKGROUND OF THE INVENTION

A conventional "open throat" crimping machine is usually no more than a converted C-frame hydraulic press. Such crimping machine uses a straight up and down pressing motion, and the tool that performs the crimping converts the straight motion into a radial pressing movement. The tool is mechanical in the sense that each segment of the tool is pressed more or less, depending upon its radial position. To achieve the open throat configuration, the tool essentially is considered to have been cut in half so that a number of die segments of the tools are secured to the top of a die cage while a corresponding number of die segments are secured to the bottom of the die cage. To operate, the upper die segments are lifted up so as to create an opened position to allow a workpiece to be loaded from the side of the machine. Once the workpiece is loaded, the upper die segments are driven downwards to thereby work cooperatively with the lower die segments to crimp the workpiece.

Thus, such conventional open throat crimping machine can only operate in two cycles, i.e., an upward movement to move the upper die segments to an opened positioned, and a punch cycle in which the upper dies are lowered to press the workpiece. Accordingly, for every pressing operation, the upper die segments have to be opened to its full opened position, irrespective of how big or small the to be crimped workpiece is.

Moreover, insofar as each of the upper and lower die segments for a conventional open throat crimping machine has to be individually mounted to the die cage, each die segment must be laboriously removed from the cage assembly in order that the dies be changed. Otherwise, a completely new cage assembly must be used for each different crimping operation.

Another type of prior art open throat machine uses mechanical linkage, applied horizontally, to the tapered surfaces of the crimp dies for crimping. This type of machine can only be top loaded and the replacement of the crimp dies necessitate a great deal of disassembly and assembly time.

SUMMARY OF THE INVENTION

The present invention open throat crimping machine is configured to a C-frame in which respective sub-frames are mounted to each end of the C-frame. Permanently coupled to each of the sub-frames are a plurality of master dies that are positioned opposed to each other and are movable either towards or away from each other. The movement of the master dies are controlled by a hydraulic drive mechanism, with feedback being provided by a linear potentiometer. The distance separating the opposed sets of master dies therefore can be determined and controlled accurately.

Removably mounted to each set of the master dies are corresponding sets of crimp dies. Each set of crimp dies is formed of a number of crimp die segments, and each crimp die segment is removably coupled to a corresponding master die segment by coacting pin members integrated to the pair of crimp die and master die segments. And when the master dies are driven to its closed position, the crimp die segments from both sets of master dies likewise are driven to the closed position to thereby effect a crimping, forming, or other types of pressing operations to a workpiece that is placed therebetween.

By being removably mounted to the respective sets of master dies, the corresponding sets of crimp die segments can be readily replaced so that a different type of crimping/forming operation could take place. Insofar as the crimp die segments are not permanently secured to the moving mechanism, for example the hydraulic drive, that moves the master dies relative to each other, the replacement of the crimp die segments is easily done. Indeed, such replacement can be accomplished by using a quick change tool specially designed for the crimping machine of the instant invention that could remove the whole set of crimp dies from the master dies in a single movement.

By controlling the distance or the open channel that separates the opposed sets of master dies, the opposed master die segments do not have to be moved to their fully opened position for the crimping of all workpeices. Accordingly, if the to be crimped workpieces are of dimensions that do not require the sub-frames to move to their fully opened position, valuable time could be saved for the crimping operation.

Another feature of the crimping machine of the instant invention resides in the fact that workpeices could be placed between the crimp dies a number of ways from a number of directions. These include passing the workpeices via the open channel, or inserting the workpeices between the opposed sets of crimp dies. Moreover, the C-frame of the crimping machine of the instant invention could be oriented in a number of positions for accommodating easy placement of workpeices between the crimp dies.

It is therefore an objective of the present invention to provide a crimping machine that has crimp dies that could be readily exchanged with other crimp dies.

It is another objective of the present invention to provide a crimping machine that can accurately determine and control the distance that separates its opposed sets of crimp dies.

It is still another objective of the present invention to provide an open throat crimping machine which crimping head could be positioned in a number of different orientations for accommodating the insertion of to be pressed workpeices.

BRIEF DESCRIPTION OF THE FIGURES

The above-mentioned objectives and advantages of the present invention will become apparent and the invention itself will be best understood by reference to the following description of an embodiment of the invention taken in conjunction with the accompanying drawings, wherein:

FIGS. 7A and 7B are respective side and front views of the segments of a crimp die being positioned in a closed relationship, and the mating thereto by a quick change tool of the instant invention; and FIGS. 8–10 are respective cross-sectional views illustrating the relationship between the crimp die and the master die of the crimping machine of the instant invention, as well as how the crimp die segments are mated to and removed from the master die segments by means of the quick change tool.

DETAILED DESCRIPTION OF THE INVENTION

Figure 2:
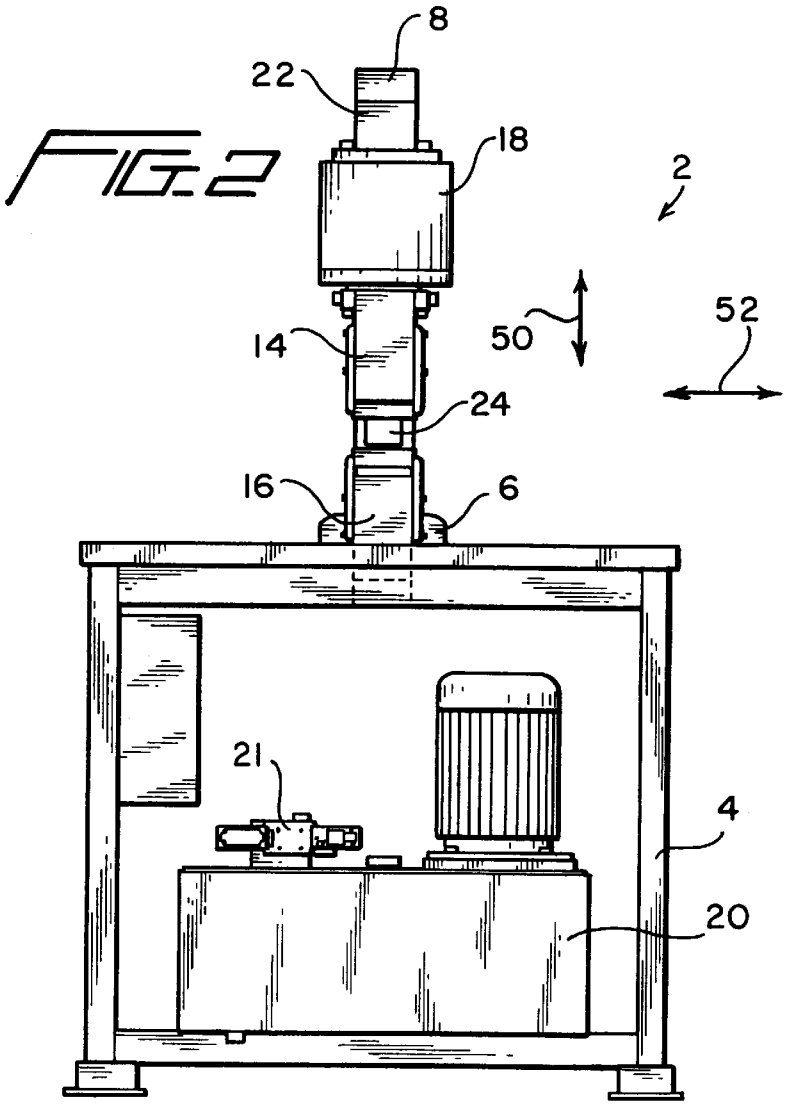
FIG. 2 is a front view of the FIG. 1 machine.
Figure 1:
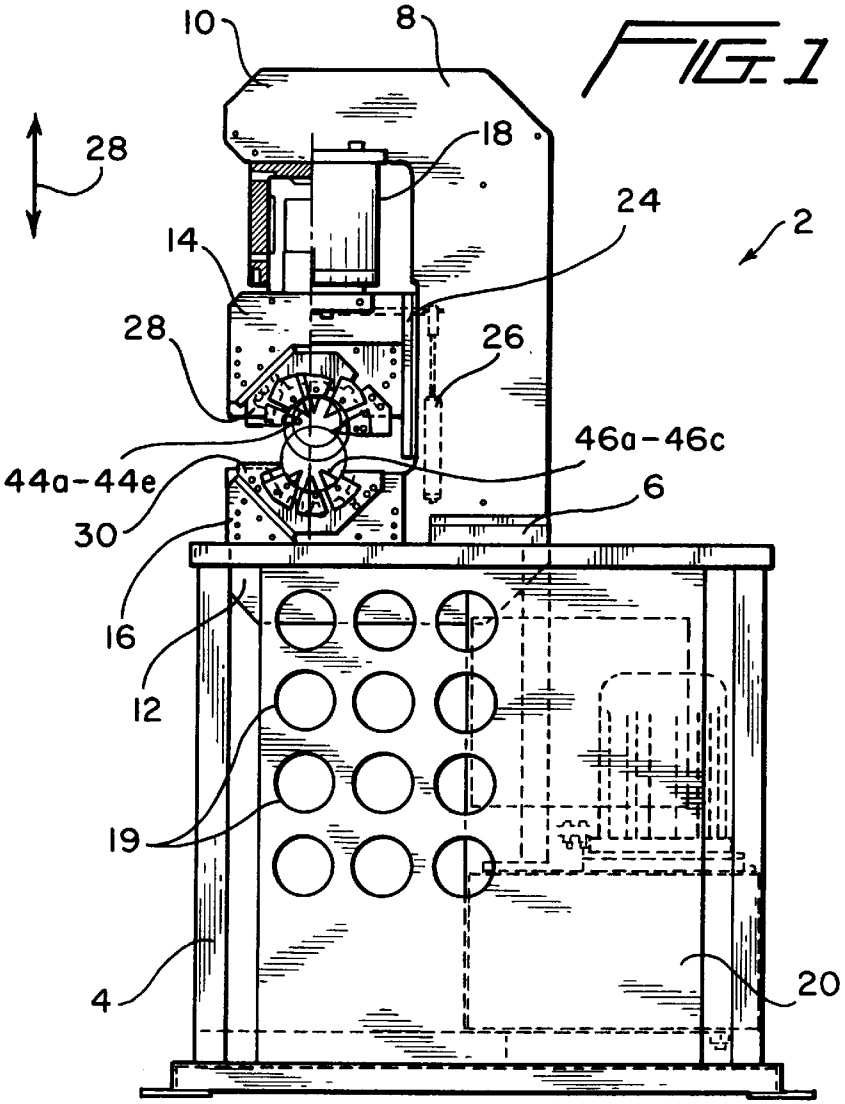
FIG. 1 is a side view of a crimping machine of the instant invention.

With reference to FIGS. 1 and 2, a crimping machine 2 is shown to include a base 4 having extended thereto a support 6. A C-shaped frame 8 is mounted to support 6 and base 4.

Figure 4:
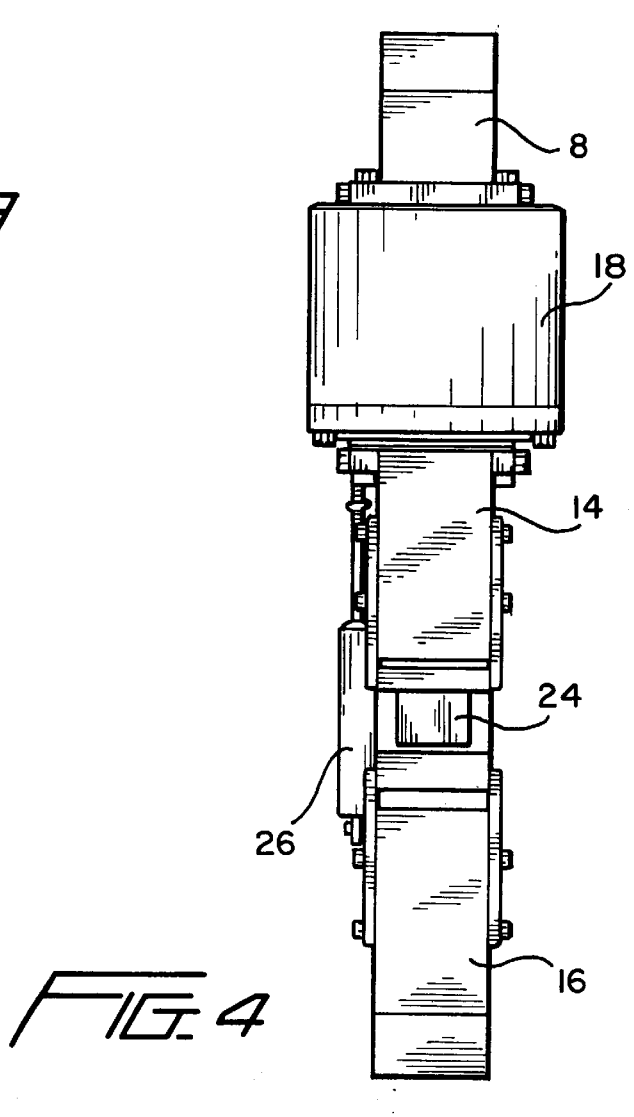
FIG. 4 is a front view of the FIG. 3 C-frame.
Figure 3:
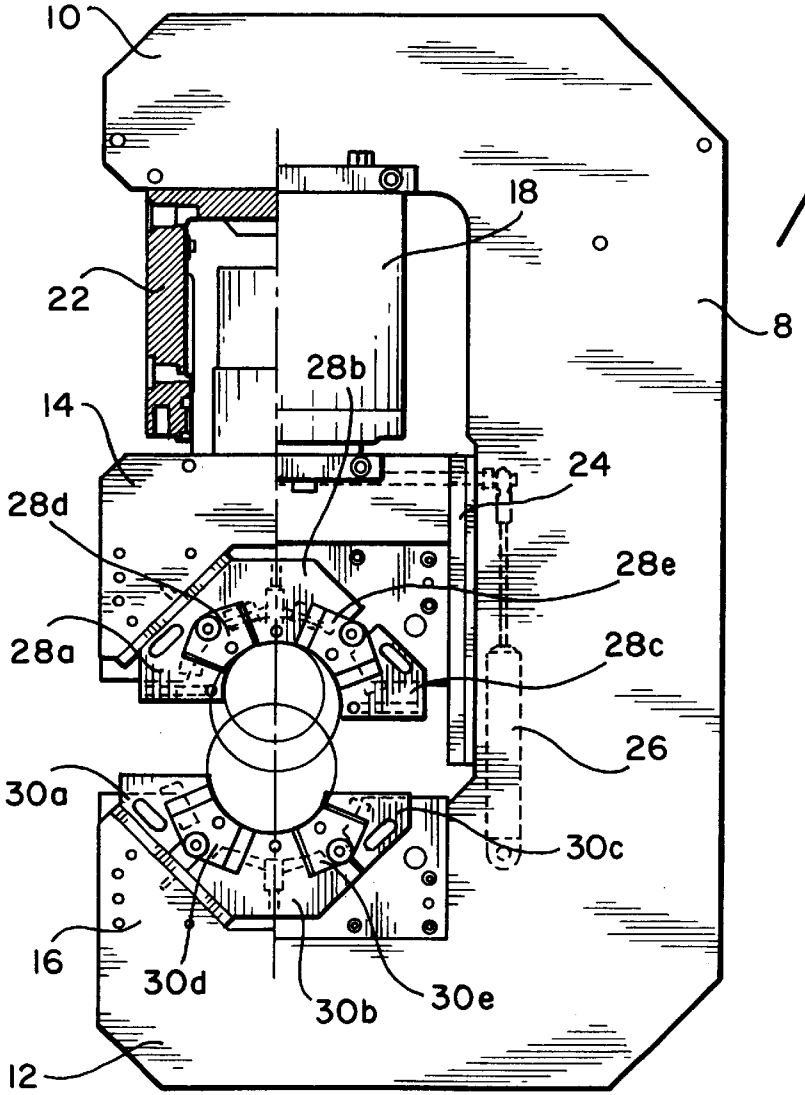
FIG. 3 is an enlarged view of the C-frame of the crimping machine of the instant invention.

As best shown in FIGS. 3 and 4, C-shaped frame 8 has two ends 10 and 12 to which respective sub-frames 14 and 16 are workingly coupled. For the being discussed embodiment, sub-frame 16 may actually be an integral part of C-shaped frame 8. Sub-frame 14 is workingly coupled to the cylinder of a hydraulic drive 18, with a half cut-away view 22, that receives its hydraulic fluid from a reservoir 20 situated within base 4. Positioned adjacent to reservoir 20 is a valve 21 that enables fluid to be provided to or removed from reservoir 20. Further shown in base 4 are a number of cavities or apertures 19, which are used for storing the tool dies to be used with the crimping machine of FIG. 1. Further discussion of the different sets of crimp die tools will be given later in the specification. For the sake of simplicity, the conduits that connect hydraulic drive 18 with reservoir 20 are not shown.

With specific reference to FIGS. 1 and 3, sub-frame 14 is shown to be workingly coupled to hydraulic drive 18 as well as a linear potentiometer 26. Linear potentiometer 26 is connected to the cylinder of hydraulic drive 18 at one end and C-shaped frame 8 at its other end. It is mounted in such a way that whenever the piston from hydraulic drive 18 moves, it will also move to thereby generate a corresponding voltage signal that is indicative of the distance of its movement.

Sub-frame 14 is moreover slidably mounted to a guide track 24 that extends longitudinally along C-frame 8. By being coupled to hydraulic drive 18 and slidably mounted to guide track 24, sub-frame 14 can be driven by hydraulic drive 18 to move along the directions as indicated by directional arrows 28, with reference to the longitudinal axis of C-frame 8.

Figure 5:
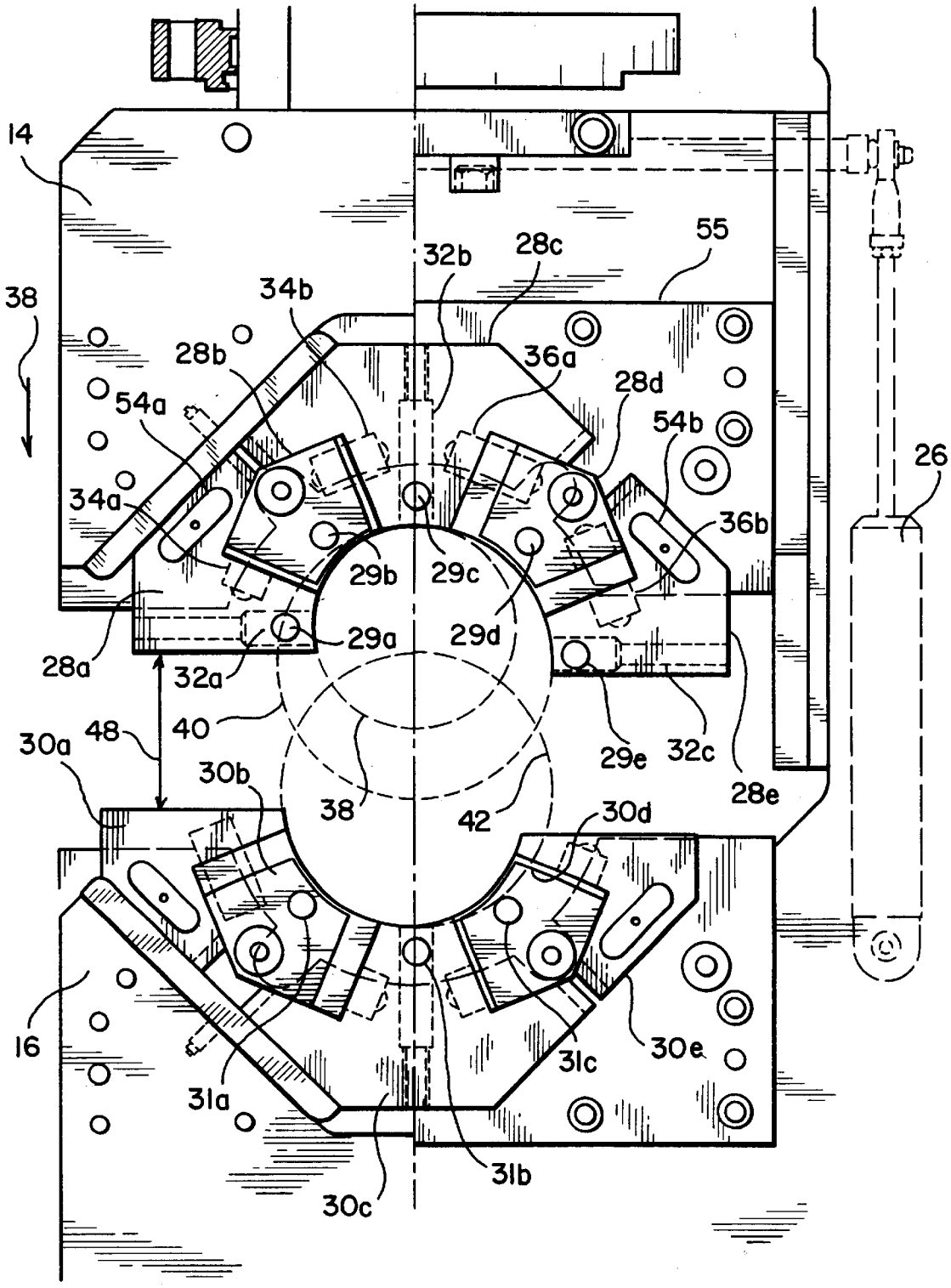
FIG. 5 is an enlarged view of the cutting head of the crimping machine of the instant invention specifically showing the respective sub-frames mounted to the C-frame of FIG. 3 and the respective master die segments fixedly coupled thereto.

As best shown in FIGS. 1, 3 and 5, sub-frames 14 and 16 each have fixedly coupled thereto a number of segments 28*a*14 28*e* and 30*a*–30*e*, respectively. Segments 28*a*–28*e* and 30*a*–30*e* may be referred to as respective halves of a master die, or the segments of the master die, of the crimping machine. Alternatively, segments 28*a*–28*e* may be referred to as a first, or an upper, set of master dies while segments 30*a*–30*e* may be referred to as a second, or a lower, set of master dies that are positioned opposed to master dies 28*a*–28*e*.

With respect to the master die segments, note that segment 28*c* is fixedly coupled to sub-frame 14 by means of a bolt 32*b*. Segments 28*a* and 28*e* are movably coupled to sub-frame 14 by means of spring connectors 34*a*, 34*b* and 36*a*, 36*b*, respectively, as well as by means of keys 54*a* and 54*b*. Segments 28*a*, 28*b*, 28*d* and 28*e* are also movably coupled to sub-frame 14 via plate 55. Segments 28*b* and 28*d* are moreover movably coupled to segments 28*a*, 28*c* and 28*e*, respectively, by means of spring connections 34*a*, 34*b* and 36*a*, 36*b*. The opening movements of segments 28*a*, 28*b*, 28*d* and 28*e* are restricted by keys 54*a* and 54*b*. Thus, master die segments 28*a*–28*e* are connected to sub-frame 14 and configured with respect to each other in such a way that as sub-frame 14 is driven in the direction as indicated by arrow 38, the respective distances separating the master die segments will get smaller and would close when sub-frame 14, and more accurately the set of master dies 28, are driven to a closed position with reference to the set of master dies 30 mounted to sub-frame 16.

Indeed, master die segments 30*a*–30*e* move synchronously with the movement of master die segments 28*a*–28*e* so that when the opposing sets of master dies 28 and 30 move into the closed position, all of the master die segments would close in such a way as to effect a void such as that represented by circle 38 shown in FIG. 5. Conversely, when master die segments 28 are moved to a so-called opened position, the inside circumference formed by segments 28*a*–28*e* would have the circumference as represented by circle 40. Similarly, master die segments 30 would have an inside circumference represented by circle 42.

The interrelationship between master die segments 30*a*–30*e* for the set of master dies that are coupled to sub-frame 16 are the same as those for master dies 28*a*–28*e*. Accordingly, no further discussion with respect to master die segments 30*a*–30*e* is deemed necessary herein.

Return to FIG. 1. There, a crimp die having two halves, in the form of two opposing sets of crimp die segments 44*a*–44*e* and 46*a*–46*c*, is shown. Although there are shown five master die segments for each set of opposed master dies, there are five and three crimp die segments for the respective sets of opposing crimp dies for the being described embodiment of the instant invention. Note, however, that the number of segments at each half of the master die could vary. So, too, could the number of segments at each half of the crimp die. In other words, there may be instances where the number of segments at each half of the master die are greater or less than five. Or for that matter, the number of segments for one half of the master die could be different from the other. The same of course is true with respect to the number of segments for the two halves of the crimp die. Putting it differently, instead of an unequal number of segments for the each half of the crimp die as being described herein, each half of the crimp die may in fact have the same number of segments.

In any event, the crimp die segments for each set of crimp dies are each removably connected to a corresponding one of the master die segments. For example, crimp die segment 44*a* is removably coupled to master die segment 28*a*, crimp die segment 44*b* is removably coupled to master die segment 28*b*, crimp die segment 44*c* is removably coupled to master die segment 28*c*, crimp die segment 44*d* is removably coupled to master die segment 28*d*, and crimp die segment 44*e* is removably coupled to master die segment 28*e*. Similarly, crimp die segments 46*a*, 46*b* and 46*c* are removably coupled to master die segments 30*b*, 30*c* and 30*d*, respectively.

The coupling of a crimp die segment to a corresponding master die segment is done by the interaction of a die set pin at the crimp die segment with a spring biased pin at the master die segment. In particular, with reference to FIGS. 7A, 7B and 8–10, each of the crimp die segments 44 (46) has fitted at its outside circumferential surface an acorn nut or die set pin 56, represented by 56*a*–56*h* for the eight segments of the exemplar crimp die of the being discussed embodiment of the instant invention. As best shown in FIG.

7B, each of the crimp die segments 44 (46) has at the surface that faces the viewer a hole or aperture 58, designated respectively as 58*a*–58*h* for the various segments of the crimp die. Note that since the positioning of each crimp die segment with respect to its corresponding master die segment as shown in FIGS. 1 and 3 is irrelevant with regard to the discussion of the interrelationship between the crimp die segments and the master die segments in FIGS. 7–10, each of the crimp die segments in FIGS. 7–10 for this discussion is designated 44 (46) while each of the master die segments is designated 28 (30).

A quick change tool 60, best shown in FIG. 10, has a handle 62 that has a plate 64 fixedly coupled to an end thereof. Extending from the surface of plate 64 away from handle 62 are a number of fingers 66 each of which is adapted to mate with aperture 58 in a corresponding one of the crimp die segments 44 (46). Plate 64 has also embedded therein a number of magnets 68 each being positioned relative to a corresponding finger 66 for magnetically attracting thereto a corresponding crimp die segment when the fingers are inserted to the respective apertures 58 of the crimp die segments.

To mate a crimp die with the master die, one of the crimp dies stored in a cavity 19 of base 4 is withdrawn with tool 60, so that crimp die segments 44 (46) are magnetically held by tool 60 as shown in FIGS. 7A and 8. With the master die opened as shown in FIGS. 1 and 3, the crimp die is inserted between the opened halves of the master die per illustrated in FIG. 8. To better understand the hereinbelow discussion of the interaction between the crimp die and master die as shown in FIGS. 8–10, insofar as the positioning of the master die segments relative to the crimp die segments is not relevant, the cross-cut segments of the master die shown in those figures are designated simply as 28 (30) and 28 (30)'.

As best shown in FIG. 5 and the cross-sectional views of FIGS. 8–10, each segment of the master die has a passage 29 (31), or 29 (31)', that extends from the surface that faces the reader (FIG. 5) to a bore 70, or 70', integrated to the master die segment in a substantial perpendicular relationship to passage 29 (31). Each of bores 70 is formed with an opening at the inner circumference surface of the master die segment.

Thus, for the exemplar segments 28*a*–28*e* of one half of the master die as shown in FIG. 5, corresponding passages 29*a*–29*e* are formed at each of the master die segments. For the other half of the master die, passages 31*a*, 31*b*, 31*c* are formed in master die segments 30*d*, 30*c*, 30*e*, respectively. A spring biased pin 72 or 72' is fitted within passage 29 (31) of each of the segments of the master die. Note that for the exemplar embodiment, there are no passages in master die segments in 30*a* and 30*e*, as those segments are used to support the respective end crimp die segments 44*a* and 44*e* that are coupled to master die segments 28*a* and 28*e*.

To mate each segment of the crimp die with a corresponding segment of the master die, as best shown in FIG. 8, with the master die being opened, the crimp die, being held by tool 60, is positioned into the channel created by the opening of the master die. Once the crimp die is sandwiched between the two halves of the master die and the respective die set pins 56 of the crimp die segments are aligned with the corresponding bores 70 formed at the various segments of the master die, the two halves of the master die are driven relatively towards each other so that each die set pin 56 is mated to a corresponding bore 70. And as each die set pin 56 is inserted to a corresponding bore 70, it pushes against the tip of the spring biased pin 72 in passage 29 so as to push spring biased pin 72 away until it is held in place in bore 70 by the indentation 76 formed at the tip of spring biased pin 72. The force with which spring biased pin 72 biases against die set pin 56 is of course provided by a spring 74 that is an integral part of the spring biased pin 72.

With the various segments of the crimp die now being secured to the corresponding segments of the master die, tool 60 is extracted from the crimp die segments, per illustration in FIG. 10. At which time, each crimp die segment is fixedly coupled to a corresponding segment of the master die, and a crimping operation can then be commenced.

To remove the crimp die from the master die, the reverse operation is effected. That is, tool 60 is moved towards crimp die 44 (46) until fingers 66 of tool 60 are inserted to the respective apertures 58 of the different crimp die segments. Thereafter the master die is opened so that the corresponding mated pairs of master die and crimp die segments become disengaged from each other, per illustration in FIG. 8. At that point, the crimp die could be withdrawn by tool 60 and may be exchanged with another crimp die.

Refer now to FIG. 5. Due to the shapes of the respective crimp die segments, when the master die segments are driven to the closed position as represented by circle 38, the crimp die segments likewise are moved to their closed position to thereby effect a crimping operation on a workpiece that is placed between the two sets of crimp dies 44 and 46. For fitting purposes, the outer diameter of the combination of crimp die segments 44*a*–44*e* corresponds to the inside diameter of the combination of master die segments of 28*a*–28*e*. The same kind of relationship is had with respect to crimp die segments 46*a*–46*c* and master die segments 30*a*–30*e*. Thus, when sub-frames 14 and 16 are moved relative to each other, due to the spring relationship among upper master die segments 28*b*, 28*d* and 28*a*, 28*c*, 28*e*, as well as among lower master die segments 30*b*, 30*d* and 30*a*, 30*c*, 30*e*, the translational movement of hydraulic drive 18 is converted radially for driving the various master die segments, and therefore the crimp die segments movably coupled thereto, with an even force for forming a workpiece placed between and surrounded by the crimp die segments.

Given that the movement of sub-frame 14 is continuously measured by linear potentiometer 26, a feedback signal is constantly being provided to the controller of the crimping device to control the amount of movement by hydraulic drive 18. The machine stroke for crimping a workpiece can therefore be accurately controlled. Accordingly, the distance separating master dies 28 and 30, as designated by 48, can be selectively controlled. Thus, for those workpeices that do not require sub-frames 14 and 16 to be moved to their fully opened position, a substantial amount of time could be saved by reducing the width of channel 48 that separates the opposed sets of master dies 28 and 30 so that the crimping operation would require a shorter movement of sub-frame 14 relative to sub-frame 16.

Moreover, given that the crimp die segments are distinct from the master die segments and are readily removable therefrom, other crimp dies that may or may not be made of the same number of crimp die segments but which outer circumferences match the inner circumference of the master die could easily be exchanged with that being used.

Figure 6:
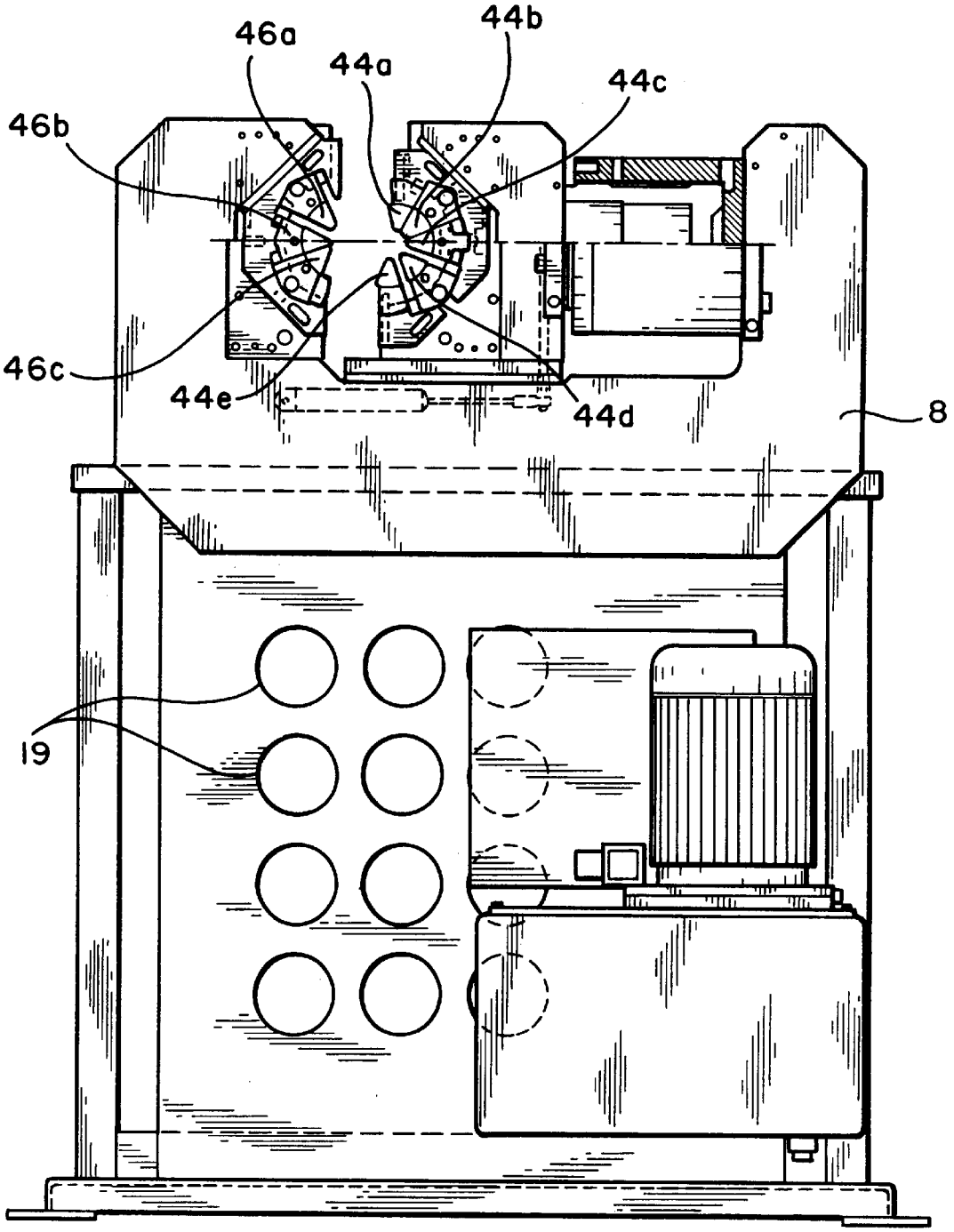
FIG. 6 is a cross-sectional view of the crimping machine of the instant invention with the C-frame being positioned in a different orientation.

FIG. 6 shows C-frame 8 of crimping machine 2 to be positioned in an orientation that allows a workpiece to be loaded between crimp dies 44 and 46 from the top of the machine, as compared to the workpiece having to be loaded into position between the crimp dies sideways from the front of the machine as shown in FIGS. 1 and 2. Irrespective of whichever position C-frame 8 is oriented, with the open throat configuration of the crimping machine of the instant invention, a workpiece can be inserted between crimp dies 44 and 46 from a direction perpendicular to the plane, designated 50, along which the various crimp dies lie. Thus, a workpiece could be inserted between crimp dies 44 and 46 by way of either of the directions as indicated by directional arrows 52 shown in FIG. 2.

While a preferred embodiment of the present invention has been disclosed herein for purposes of explanation, numerous changes, modifications, variations, substitutions and equivalents in whole and in part, should now be apparent to those skilled in the art to the which the invention pertains. Accordingly, it is intended that this invention be limited only by the spirit and scope of the hereto appended claims.

What is claimed is:

1. A crimping machine, comprising:

a frame;

a first set of master dies movably coupled to said frame;

a second set of master dies opposing said first set of master dies movably coupled to said frame;

one set of crimp dies removably mated to said first set of master dies;

an other set of crimp dies removably mated to said second set of master dies; and drive means for selectively moving said first and second sets of master dies relative to each other;

wherein said crimp dies cooperate to effect a crimping operation when said first and second sets of master dies move towards each other.

2. Machine of claim 1, wherein said one and other sets of crimp dies are exchangeable from said first and second sets of master dies, respectively, with other cooperating sets of one and other crimp dies for effecting other crimping operations.

3. Machine of claim 1, wherein said frame comprises a C-shaped support having coupled to each end portion thereof one of said sets of master dies, a channel of selectable width separating said sets of opposed master dies when said sets of master dies have not been driven to a closed position.

4. Machine of claim 3, wherein a workpiece is positionable between said sets of crimp dies by either being passed through said channel separating said sets of master dies or be inserted between said sets of crimp dies from a direction perpendicular to the plane along which said sets of crimp dies lie; and wherein said C-shaped support is positionable in a plurality of orientations relative to ground.

5. Machine of claim 1, wherein each of said first and second sets of master dies comprises three members each coupled to said frame and two members springingly coupled to at least said three members, all of the members in each of said first and second sets of master dies moving closer together as said sets of master dies are driven towards each other for effecting said crimping operation.

6. Machine of claim 5, wherein there are five crimp dies each mated to a corresponding member of said first set of master dies and three opposing crimp dies each mated to a corresponding member of said second set of master dies, said crimp dies being driven towards a central location whereat a workpiece is positioned as said respective sets of master dies are moved closer together to drive each of said crimp dies with the same force against said workpiece.

7. Machine of claim 1, wherein each of said crimp dies has an outside diameter that is the same as the inside diameter of a corresponding one of said master dies.

8. Machine of claim 1, wherein said one and other sets of master dies each are coupled to a sub-frame, said machine further comprising:

a track whereon at least one of said sub-frames of said sets of master dies is slidably mounted, said at least one sub-frame being driven by said drive means along said track either towards or away from the other of said sub-frames.

9. Machine of claim 2, wherein each of crimp dies has an aperture at a surface thereof orthogonal to its working surface, said crimp dies forming a cylinder when they are positioned adjacent to each other, further comprising:

a tool having a plurality of fingers each adapted to be inserted into the aperture of a corresponding one of said crimp dies when said crimp dies form said cylinder, said tool including means to hold said crimp dies to said fingers for installation to, or removal from, said first and second sets of master dies.

10. In combination, a C-shaped frame having mounted at the respective ends thereof a set of master dies, each of said set of master dies having removably mated thereto one of two portions of one coacting set of crimp dies so that the respective portions of said one coacting set of crimp dies are positioned opposed to each other, said sets of master dies being movable relative to each other to form a channel of selectable width separating said portions of said one coacting set of crimp dies between an opened position and a closed position.

11. Combination of claim 10, further comprising:

at least an other coacting set of crimp dies to be exchanged with said one coacting set of crimp dies for effecting a crimping operation different from that performable by said one coacting set of crimp dies.

12. Combination of claim 10, wherein there are a plurality of cooperating members in each of said sets of master dies and a corresponding plurality of cooperating members in each portion of said one coacting set of crimp dies.

13. Combination of claim 10, wherein each of said set of master dies is mounted to a sub-frame that is movably coupled to one of said respective ends of said C-shaped frame via a guide track, at least one of said sub-frames being slidably driven by a driving means along said track so that said sub-frames are guidingly moved relative to each other.

14. Combination of claim 10, wherein a workpiece is positionable between said portions of said one coacting set of crimp dies for crimping by said crimp dies, said workpiece being positioned by either being passed through said channel formed by said sets of master dies or be inserted between said sets of crimp dies from a direction perpendicular to the plane along which said crimp dies lie; and wherein said C-shaped frame is positionable in a plurality of orientations relative to ground.

15. Combination of claim 10, wherein said one coacting set of crimp dies has an outside circumferential surface that is the same as the inside circumferential surface formed by said sets of master dies when said sets of master dies are in said closed position.

16. A crimping machine, comprising:

a frame;

a master die movably mounted to said frame, said master die having at least two halves each including a plurality of master segments;

a crimp die removably fitted to said master die, said crimp die having at least two portions each fitted to a corresponding half of said master die, each portion of said crimp die having a plurality of crimp segments;

wherein said crimp die is in an opened position when said two portions are separated from each other and a closed position when said plurality of crimp segments of said two portions are in pressing relationship with each other for effecting a crimping operation.

17. Machine of claim 16, wherein said crimp die has an outer diameter that is the same as the inside diameter of said master die; and wherein respective means in said crimp die and said master die coact with each other to fixedly couple said crimp die to said master die.

18. Machine of claim 16, further comprising:

an other crimp die having two portions each including a plurality of crimp segments, said other crimp die being exchangeable with said crimp die.

19. Machine of claim 16, wherein said frame is C-shaped and said halves of said master die each are mounted to a corresponding end of said frame, said halves of said master die and the respective portions of said crimp die fitted thereto being movable between said opened and closed positions for crimping a workpiece placed therebetween.

20. Machine of claim 16, wherein said frame comprises a C-shaped support having coupled to each end portion thereof one of said sets of master dies, a channel of selectable width separating said sets of opposed master dies when said sets of master dies have not been driven to said closed position.

21. Machine of claim 16, wherein there are a plurality of master die segments in each half of said master die and a plurality of crimp die segments in each portion of said crimp die.

22. Machine of claim 16, wherein each half of said master die is coupled to a sub-frame, said machine further comprising:

a track whereon at least one of said sub-frames is slidably mounted, said sub-frames being driven relative to each for moving said halves of said master die either towards or away from each other.

23. Machine of claim 16, further comprising:

a tool having a plurality of fingers each adaptable to be inserted to a corresponding aperture formed on said crimp die for installing or removing said crimp die from said master die.

24. A method of crimping a workpiece, comprising the steps of:

coupling a first set of master dies to a frame;

coupling a second set of master dies opposing said first set of master dies to said frame;

removably mating one set of crimp dies to said first set of master dies;

removably mating an other set of crimp dies to said second set of master dies; and driving said first and second sets of master dies towards each other to move said one and other sets of crimp dies to cooperatively effect a crimping operation.

25. Method of claim 24, further comprising the step of:

exchanging said one and other sets of crimp dies from said first and second sets of master dies, respectively, with other cooperating sets of one and other crimp dies for effecting other crimping operations.

26. Method of claim 24, further comprising the steps of:

placing a workpiece between said sets of crimp dies by either passing said workpiece through a channel separating said sets of master dies when said opposing sets of master dies are in an opened position, or inserting said workpiece between said sets of crimp dies from a direction perpendicular to the plane along which said sets of crimp dies lie.

27. Method of claim 24, wherein said frame comprises a C-shaped support, said method further comprising the steps of:

coupling to each end portion of said C-shaped support one of said sets of master dies;

movably separating said sets of opposed master dies to form a channel having a selected width; and positioning said C-shaped support in a plurality of orientations relative to ground.

28. Method of claim 24, wherein each of said first and second sets of master dies comprises three members each coupled to said frame and two members springingly coupled to at least said three members, said method further comprising the step of:

moving all of the members in each of said first and second sets of master dies closer together by driving said sets of master dies towards each other for effecting said crimping operation.

29. Machine of claim 28, wherein there are a plurality of crimp dies each mated to a corresponding member of said first set of master dies and a different number of plurality of opposing crimp dies each mated to a corresponding member of said second set of master dies, said method further comprising the step of:

driving each of said crimp dies with the same force towards a central location whereat a workpiece is placed so that said workpiece is evenly pressed by said crimp dies.

* * * * *